US008156634B2

(12) United States Patent
Gallup et al.

(10) Patent No.: US 8,156,634 B2
(45) Date of Patent: Apr. 17, 2012

(54) METHOD OF ASSEMBLING AN ELECTRONIC COMPONENT

(75) Inventors: David A. Gallup, Schaumburg, IL (US); Lawrence B. LeStarge, Algonquin, IL (US)

(73) Assignee: Coilcraft, Incorporated, Cary, IL (US)

( * ) Notice: Subject to any disclaimer, the term of this patent is extended or adjusted under 35 U.S.C. 154(b) by 386 days.

(21) Appl. No.: 11/137,730

(22) Filed: May 25, 2005

(65) Prior Publication Data

US 2005/0264389 A1 Dec. 1, 2005

Related U.S. Application Data

(63) Continuation of application No. 10/756,854, filed on Jan. 14, 2004, now Pat. No. 6,914,506.

(60) Provisional application No. 60/441,360, filed on Jan. 21, 2003.

(51) Int. Cl.

| | |
|---|---|
| ***H01F 17/04*** | (2006.01) |
| ***H01F 27/02*** | (2006.01) |
| ***H01F 27/06*** | (2006.01) |
| ***H01F 27/29*** | (2006.01) |

(52) U.S. Cl. ..... 29/605; 29/606; 29/858; 336/196; 336/213

(58) Field of Classification Search ..... 29/605, 29/606, 602.1, 842, 841, 848, 858; 156/277, 156/293, 212, 213; 336/65, 68, 213, 90–98, 336/196; 206/714, 716, 719

See application file for complete search history.

(56) References Cited

U.S. PATENT DOCUMENTS

| | | | | |
|---|---|---|---|---|
| 5,010,313 | A * | 4/1991 | Kaneko et al. | 335/296 |
| 5,307,041 | A * | 4/1994 | Kato et al. | 336/83 |
| 5,386,343 | A * | 1/1995 | Pao | 361/761 |
| 5,700,623 | A * | 12/1997 | Anderson et al. | 430/256 |
| 5,751,203 | A * | 5/1998 | Tsutsumi et al. | 336/65 |
| 5,760,669 | A | 6/1998 | Dangler et al. | |
| 5,861,790 | A * | 1/1999 | Johnson et al. | 336/200 |
| 6,117,509 | A * | 9/2000 | Lee | 428/40.1 |
| 6,285,272 | B1 * | 9/2001 | Boytor et al. | 336/83 |
| 6,359,541 | B1 | 3/2002 | Watanabe | |
| 6,451,154 | B1 * | 9/2002 | Grabau et al. | 156/300 |
| 6,461,895 | B1 * | 10/2002 | Liang et al. | 438/107 |
| 6,483,412 | B1 * | 11/2002 | Holdahl et al. | 336/192 |
| 6,486,398 | B1 * | 11/2002 | McCulloch et al. | 174/539 |
| 6,573,822 | B2 * | 6/2003 | Ma et al. | 336/223 |
| 6,653,923 | B2 * | 11/2003 | Li et al. | 336/206 |
| 6,661,323 | B2 | 12/2003 | Chang et al. | |

(Continued)

FOREIGN PATENT DOCUMENTS

JP 09092542 A * 4/1997

(Continued)

OTHER PUBLICATIONS

Machine Translation of JP9092542A.*

(Continued)

*Primary Examiner* — Livius R Cazan

(74) *Attorney, Agent, or Firm* — Fitch, Even, Tabin & Flannery, LLP

(57) ABSTRACT

A method of assembling an electronic component in accordance with the invention comprises providing an electronic component having a body and a core and applying a film over at least a portion of the body and core so that the film secures the body and core to one another.

16 Claims, 13 Drawing Sheets

U.S. PATENT DOCUMENTS

| | | | | |
|---|---|---|---|---|
| 6,759,935 | B2 | 7/2004 | Moro et al. | |
| 6,768,409 | B2 * | 7/2004 | Inoue et al. | 336/200 |
| 6,788,181 | B2 * | 9/2004 | Yeh et al. | 336/192 |
| 6,791,445 | B2 | 9/2004 | Shibata et al. | |
| 6,809,622 | B2 | 10/2004 | Hirohashi et al. | |

FOREIGN PATENT DOCUMENTS

| | | | |
|---|---|---|---|
| JP | 2001-044044 | A | 2/2001 |
| JP | 2001338818 | A * | 12/2001 |

OTHER PUBLICATIONS

PCT International Search Report and Written Opinion of the International Searching Authority for PCT/US2004/01081 dated May 20, 2005.

* cited by examiner

METHOD OF ASSEMBLING AN ELECTRONIC COMPONENT

CROSS REFERENCE TO RELATED APPLICATION

This application is a continuation of prior application Ser. No. 10/756,854, filed Jan. 14, 2004, now U.S. Pat. No. 6,914,506 which claims benefit of Provisional Application No. 60/441,360, filed Jan. 21, 2003, which are hereby incorporated herein by reference in their entirety.

BACKGROUND OF THE INVENTION

This invention relates generally to electronic components and more particularly concerns low profile surface mountable inductive components having a structure that improves the manufacturability and performance of the component.

The electronics industry provides a variety of wire wound components such as inductors which come in a variety of package types and configurations. For example, inductors may be provided in through-hole or surface mount package configurations. In addition, some inductors are provided with a base structure, such as a plastic header, having an internal opening through which a core, such as a drum or bobbin type core, is disposed and mounted.

Although many advances have been made with respect to the packaging and structural arrangements of wire wound components, most (if not all) of the available components continue to use traditional gluing or potting methods to attach the various pieces of the component, (e.g., core, base, etc.), to one another. More particularly, the core and base structures of existing open base wire wound inductive components are typically connected by attaching the core to the base at the edges of the core. For example, with respect to existing coil components having bobbin type cores, the core and base are normally attached by connecting at least one of the flanged ends of the bobbin core to the base. Such methods and configurations for attaching the pieces of wire wound components are problematic for a variety of reasons.

One problem associated with the use of existing gluing or potting methods to attach the pieces of a wire wound component (or coil component) is the inability of the adhesive to withstand the harsh conditions the component is exposed to during its production and use. For example, surface mount components are attached to a printed circuit board (PCB) via solder paste, which requires the PCB and component to be passed through a solder reflow oven at temperatures high enough to briefly melt the solder paste and heat the leads or terminals of the component and corresponding lands on the PCB so that the solder can electrically connect the component to the lands or traces on the PCB. Similarly, through-hole components are connected to PCBs by placing the leads or terminals of the component through holes in the PCB and then passing the PCB and the component through a solder bath (or solder wave) which is run at temperatures high enough to heat the leads of the component and lands on the PCB so that the solder can electrically connect the component to the lands on the PCB. Unfortunately, most adhesives become rigid when subjected to such high temperatures and lose their flexibility which can cause the wire wound component to fail specified vibration parameters, as will be discussed further below.

In addition to the high temperatures encountered during the placement of the component on a PCB, the adhesive must also be able to withstand wide ranges of temperatures and other environmental conditions the component will be subjected to during its lifetime. For example, in automotive applications, the component may be subjected to, and must withstand, a range of temperatures, (e.g., −40° C. to +150° C.), and the associated thermal stresses that accompany such temperatures. Thus, the adhesives used must allow the pieces of the component to move to account for such things as thermal expansion and contraction of the materials used in each component, thermal shock, thermal cycling, and the like. As mentioned above, most adhesives become rigid when subjected to such temperature ranges and lose some flexibility. Often times, this reduction in the flexibility of the adhesive can lead to the pieces of the component damaging one another when movement occurs due to thermal expansion and contraction.

In addition to the wide range of temperatures and associated movements, the component must also withstand additional stresses and environmental tests such as mechanical shock and mechanical vibration. For example, during product validation the component may be subjected to various shock and vibration tests which require the adhesive to withstand movements of the pieces of the component such as axial movement of the core with respect to the base. These stresses and conditions often prove too demanding for traditional adhesives. For example, in components having bobbin cores glued to base structures at the edges of the flanged end of the bobbin core, the glue often provides too much or too little axial movement of the bobbin with respect to the base. More particularly, since the bobbin is inherently weaker in axial flexure at the edges of the flanged ends it often does not allow for the desired axial movement when connected about the edges, thereby increasing the risk of component damage such as cracking and/or component failure. In other instances, the connection between the bobbin and the base may provide too much axial movement between the core and base. This too can increase the risk of component damage to either the core or base. The glue also adds weight which must be born by the base and core during mechanical shock and vibration testing. The extra mass load of the glue on the base and core, and the failure of distributing this mass over a larger portion of the base and core, often can lead to damage and failure of the component during vibration and mechanical shock validation.

Another problem associated with use of adhesives in coil components is the inability of the adhesive to be applied to small parts in a uniform and efficient manner. In addition, existing gluing or potting methods are labor intensive and difficult to automate. Often times, the manual and automatic processes used to apply the glue leave glue on the top and bottom surfaces of the bobbin which disrupts these otherwise planar surfaces of the component and may make the component rest unevenly on a PCB or make the component difficult or impossible to pick up and place with industry standard pick-and-place machinery. For example, excess glue on the bottom surface of the component (e.g., bobbin, legs or base), may alter the height of the component which can make the component unacceptable for various low profile component applications such as PCMCIA cards, laptop computers, PDAs, mobile telephones, and the like. In another example, excess glue on the upper surface of the component (e.g., bobbin or base) can prevent the vacuum tip of a pick-and-place machine from establishing sufficient suction force to lift the component out of its reel and tape packaging so that it can be placed on the PCB.

Traditional gluing methods may also result in the glue leaking out between the bobbin and base leaving little or no glue at the edges of the bobbin flange and base. Such instances result in weak or missing connections between the pieces of the component and increase the likelihood of component, or circuit, failure during testing. The glue may also overflow the sides of the base which can result in an unacceptable condition. For example, in densely populated circuits where component footprints and size are critical features, hardened glue extending from the side of a component may prevent the component from being packaged within its tape and reel compartment, or from being accurately positioned on the corresponding lands of the PCB due to the glue contacting other components or structures on the circuit, or from being placed on the circuit at all due to an inability to clear other components or structures.

Accordingly, it has been determined that the need exists for an improved wire wound component and method for manufacturing same which overcome the aforementioned limitations and which further provide capabilities, features and functions, not available in current devices and methods for manufacturing.

DESCRIPTION OF THE PREFERRED EMBODIMENTS

Figure 1A:
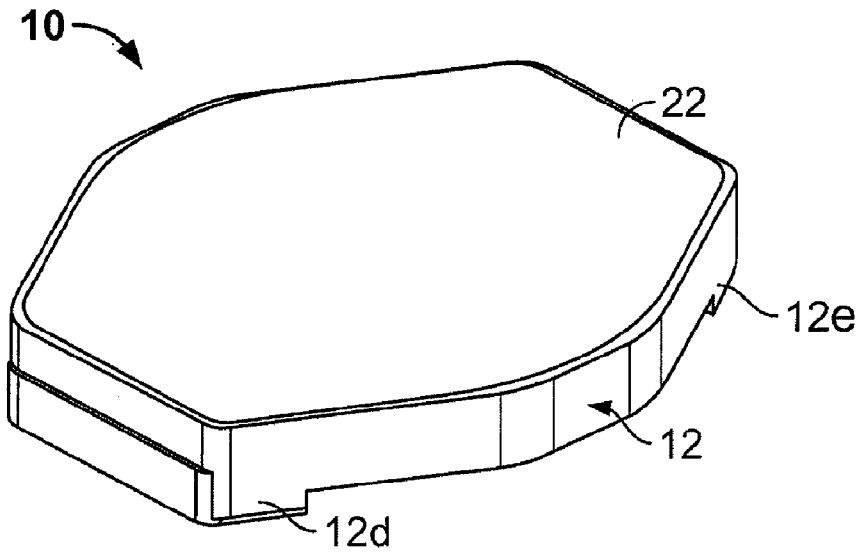
FIG. 1A is a perspective view of a coil component embodying features of the present invention.
Figure 1B:
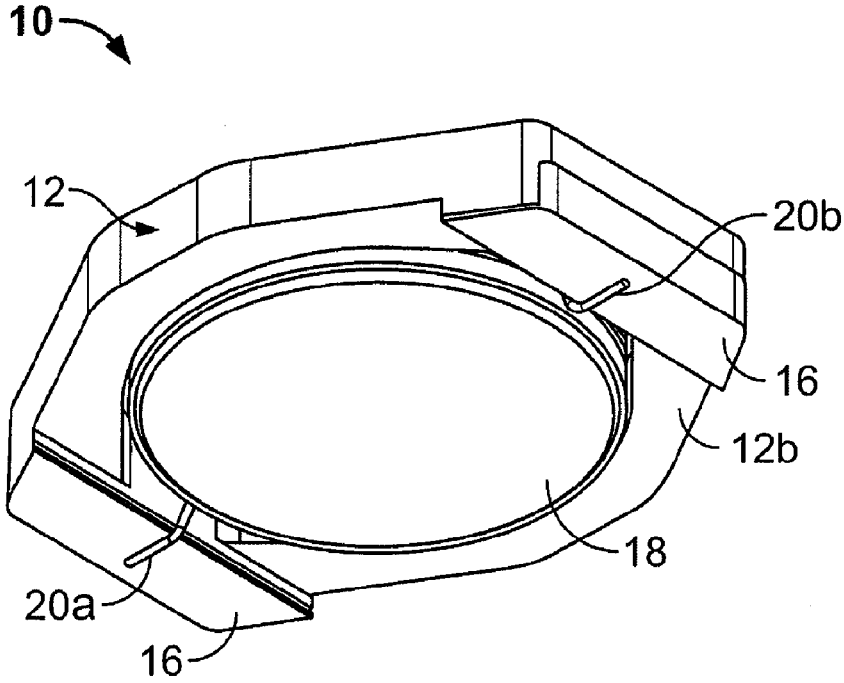
FIG. 1B is an alternate perspective view of the component of FIG. 1A.
Figure 1C:
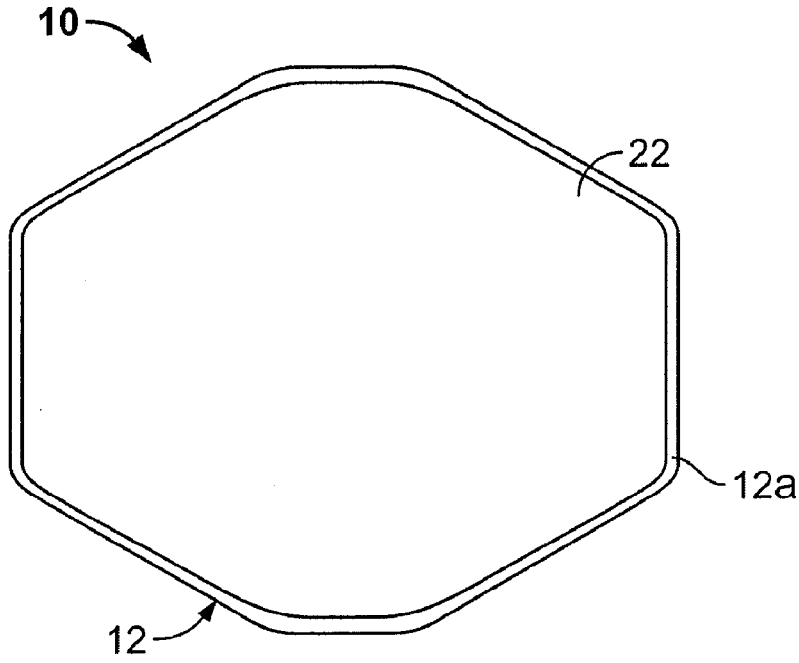
FIG. 1C is a plan view of the component of FIG. 1A.

An inductive component in accordance with the invention includes a core which is connected to a base via a film having an adhesive coating on at least one side. In a preferred form, the core is made of a magnetic material such as ferrite and the base has a plurality of metalized pads attached thereto for electrically and mechanically connecting the component to a printed circuit board (PCB). The component further includes a winding of wire wound about at least a portion of the core, with the ends of the wire winding being electrically and mechanically connected to the metalized pads.

Turning first to FIGS. 1A-H, there is illustrated a wire wound inductive component 10 embodying features of the present invention. In the embodiment illustrated, the inductive component 10 is configured in a surface mount package for mounting on a PCB, which is, for convenience, described herein as it would be positioned on the upper surface of a PCB.

The inductive component 10 includes a body or base, such as header 12, made of an insulating material, such as a non-conductive plastic or ceramic. The body 12 has a polygonal shape, such as an octagon, and has a smooth planer top 12*a* and bottom 12*b*. The body 12 defines an aperture 14 passing directly through the center of the top 12*a* and bottom 12*b*, and having an inner wall 12*c*.

In the illustrated embodiment, a pair of supports, such as legs 12*d* and 12*e*, extend downward from opposite ends of the body 12 and have metalized pads (e.g., soldering pads) located at the bottom thereof. The metalizied pads 16 are made of a conductive material and are fused or bonded to the base 12 so that the component 10 may be electrically and mechanically attached to corresponding lands or traces located on the PCB via solder. More particularly, the metalized pads 16 provide an electrically conductive surface to which the solder paste printed on the PCB can bond once the component 10 and PCB are passed through a reflow oven. As is depicted in FIG. 1E, each soldering pad 16 is preferably L-shaped so that it covers at least a portion of the bottom surface and outer side of the associated leg 12*d* or 12*e* . This pad shape increases the surface area of the metalized pads 16, thereby strengthening the coupling between the metalized pads 16 and base 12, and between the metalized pads 16 and corresponding lands on the PCB. in alternate embodiments, U-shaped pads may be used which extend across the lower surface and sides of legs 12*d* and 12*e*. Such pads provide even more surface area and connection strength between the base 12, pads 16, and corresponding PCB lands. In yet other embodiments, however, the component 10 may be designed without legs extending from the bottom of the base 12 and the pads 16 may be connected directly to the bottom surface 12*b* of base 12.

The inductive component 10 further includes a core 18, which is preferably made of a magnetic material, such as ferrite. The core 18 has a bobbin structure including a cylindrical center section 18*a* with upper and lower flanges 18*b* and 18*c*, respectively, extending from the ends of the center section 18*a*. The core 18 is disposed in the aperture 14 with the first or upper flange 18*b* fitting within the inner wall 12*c* of body 12 and the second or lower flange 18*c* resting between either, or both, the legs 12*d-e* and metalized pads 16. The core 18 is positioned so that the top of the upper flange 18*b* is about even, or coplanar, with the top surface 12*a* of body 12 and the lower surface of the lower flange 18*c* is about even, or coplanar, with the bottom surface of the legs 18*d-e* and/or metalized pads 16. Although the core illustrated is symmetrical, it should be understood that a variety of different cores may be used, including asymmetrical cores, (e.g., cores having one flange larger in diameter than the other flange, etc.), as will be discussed in further detail below. It should be understood that in the alternate embodiment of component 10, wherein the component has no legs, the bottom surface of the lower flange 18*c* is almost even, or coplanar, with the bottom surface 12 and/or metalized pads 16.

Figure 1D:
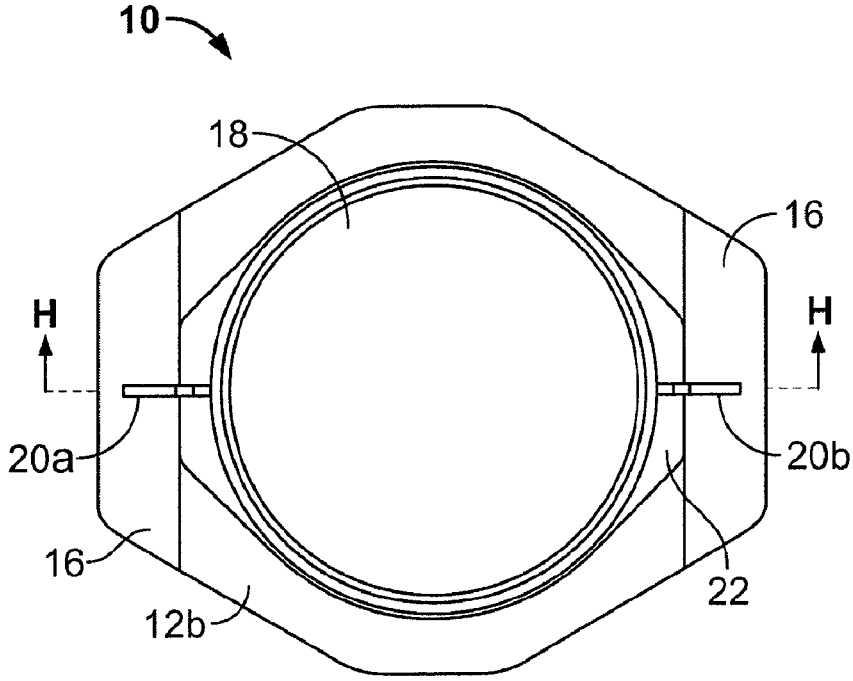
FIG. 1D is a bottom view of the component of FIG. 1A.
Figure 1E:
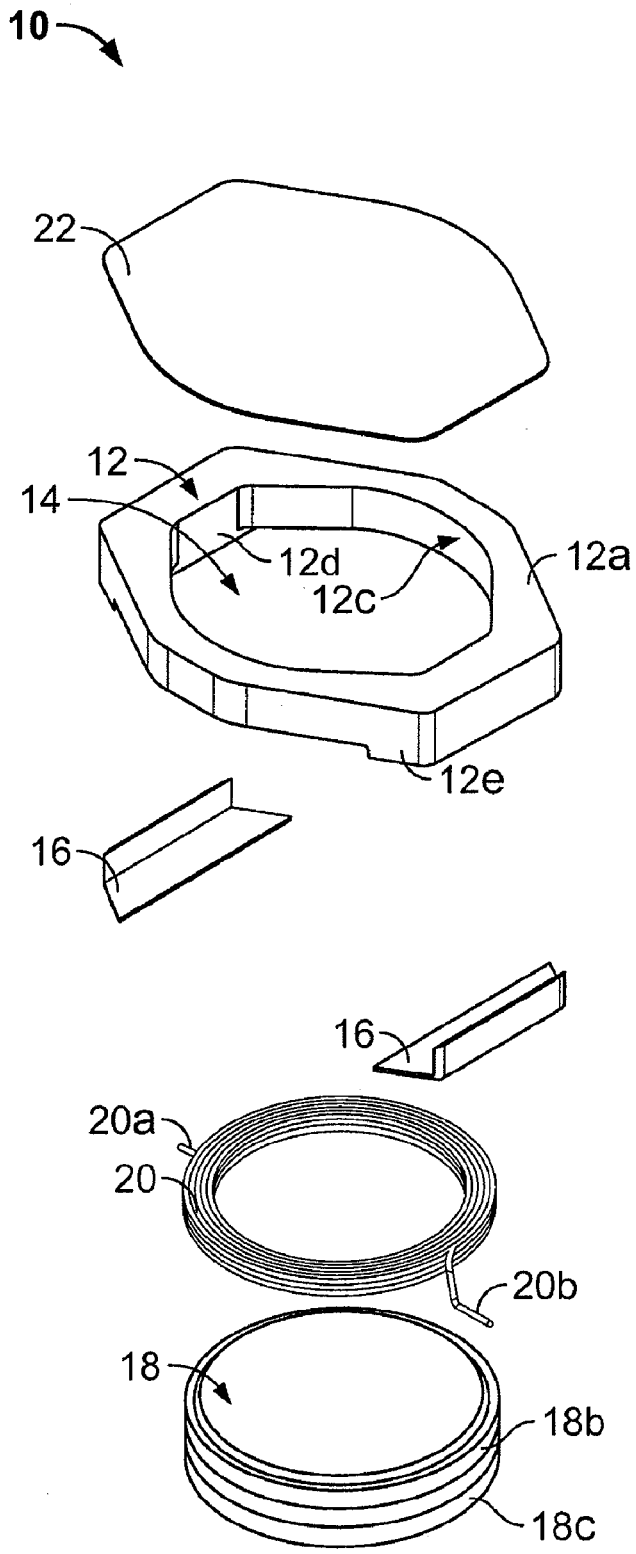
FIG. 1E is an exploded view of the component of FIG. 1A.
Figure 1F:
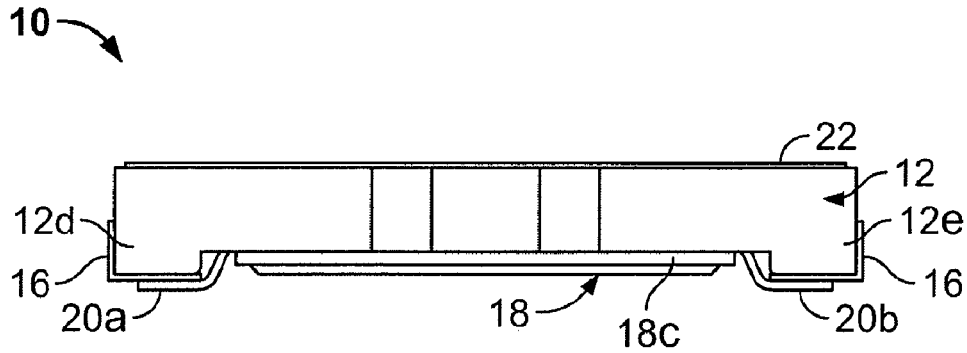
FIGS. 1F-G are side and end elevational views, respectively, of the component of FIG. 1A.
Figure 1G:
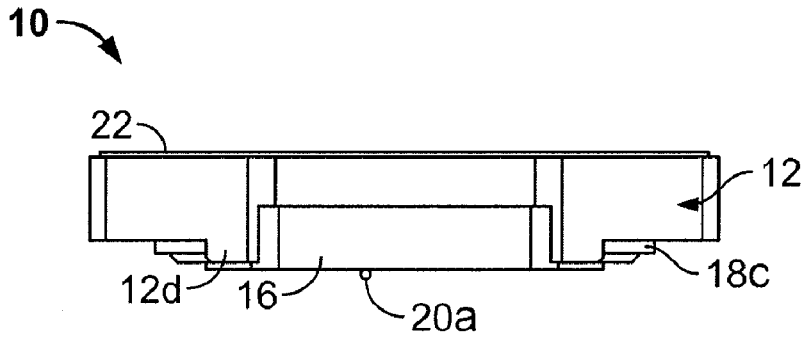
Figure 1H:
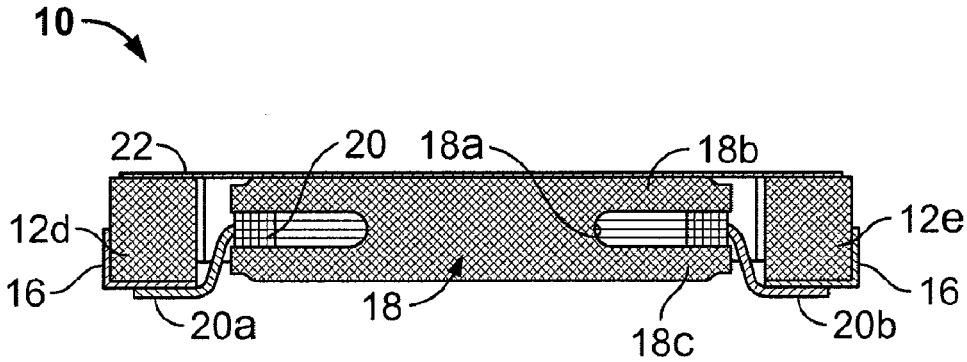
FIG. 1H a cross-sectional view of the component of FIG. 1A taken along line H-H in FIG. 1D.
Figure 2A:
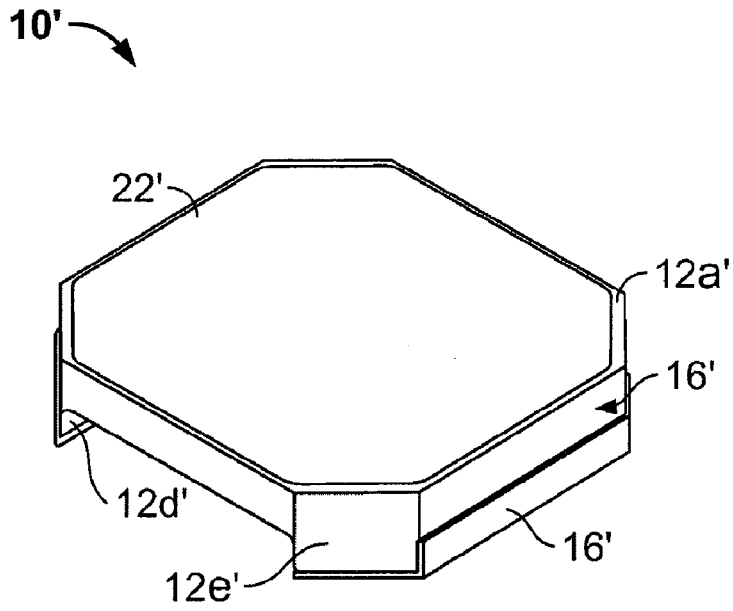
FIG. 2A is a perspective view of an alternate coil component embodying features of the present invention.
Figure 2B:
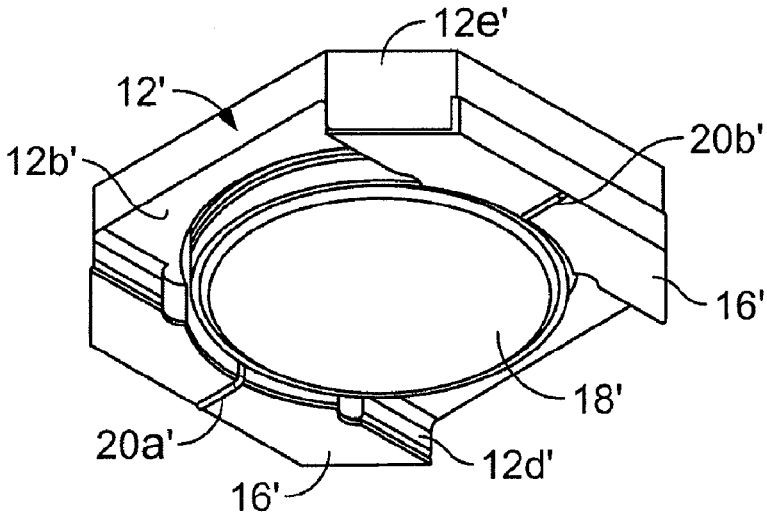
FIG. 2B is a perspective view of the component of FIG. 2A.
Figure 2C:
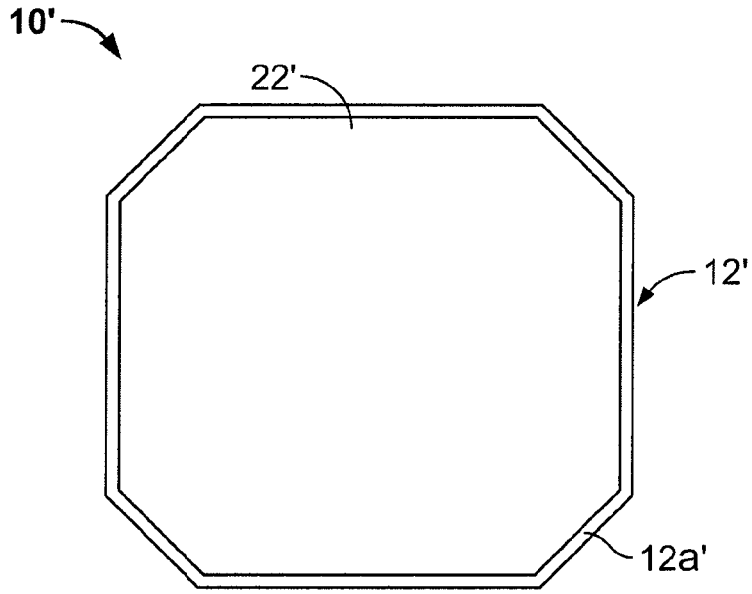
FIG. 2C is a plan view of the component of FIG. 2A.
Figure 2D:
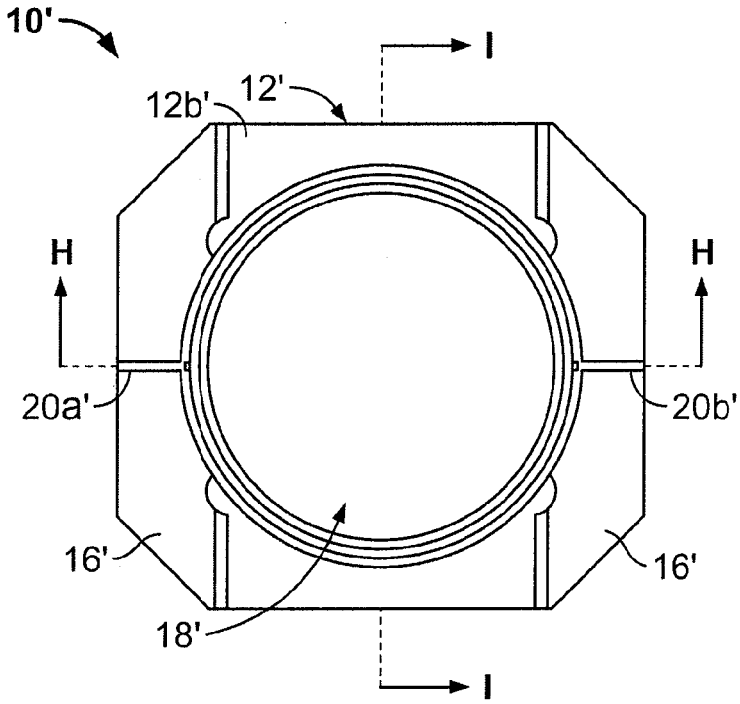
FIG. 2D is a bottom view of the component of FIG. 2A.
Figure 2E:
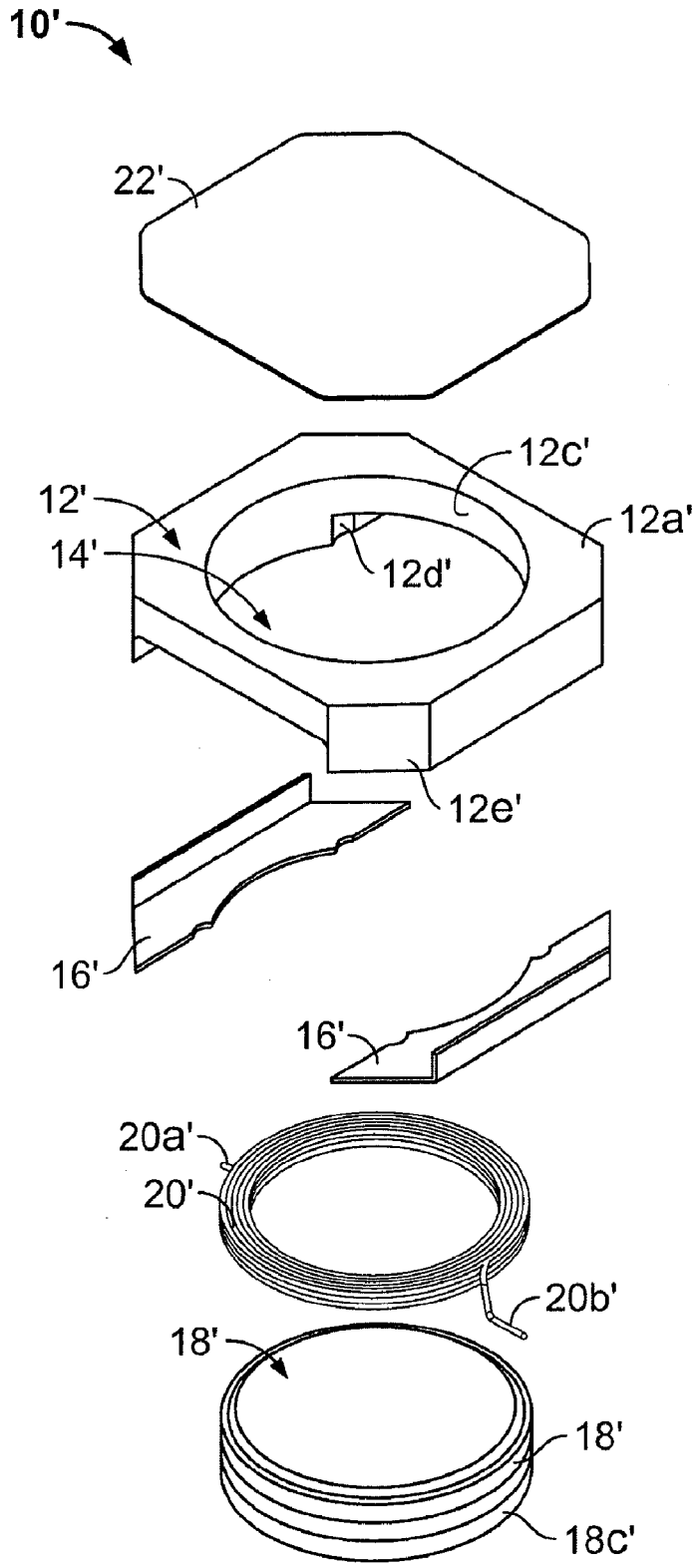
FIG. 2E is an exploded view of the component of FIG. 2A.
Figure 2F:
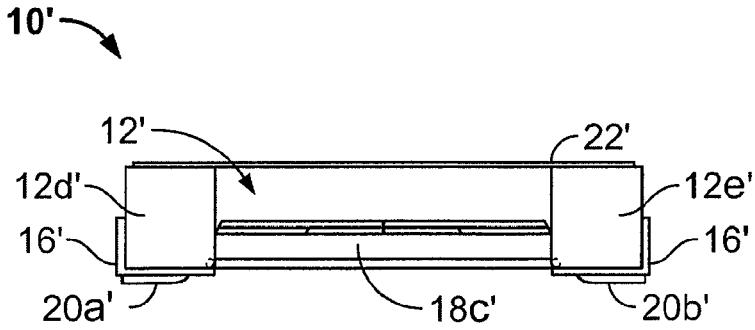
FIGS. 2F-G are side and end elevational views, respectively, of the component of FIG. 2A.
Figure 2G:
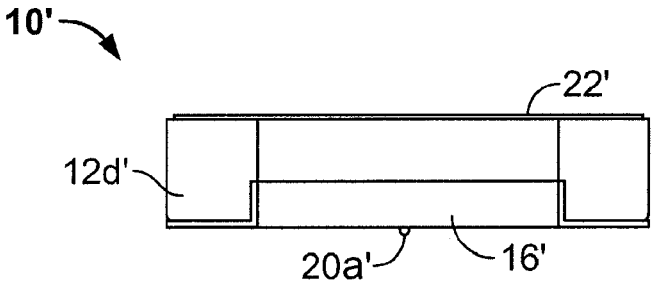
Figure 2H:
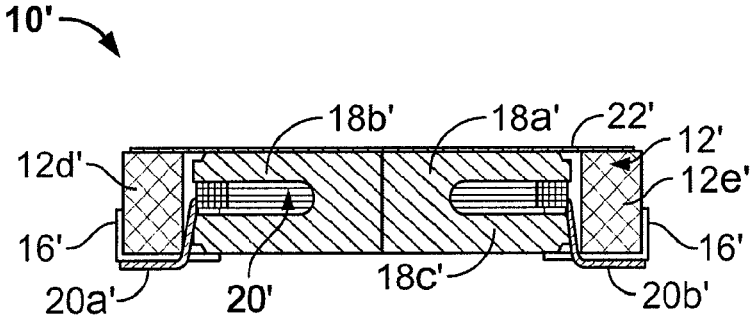
FIG. 2H is a cross-sectional view of the component of FIG. 2A taken along line H-H in FIG. 2D.
Figure 2I:
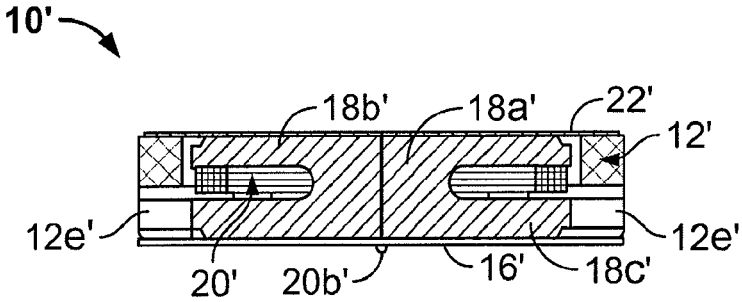
FIG. 2I is a cross-sectional view of the component of FIG. 2A taken along line I-I in FIG. 2D.
Figure 3A:
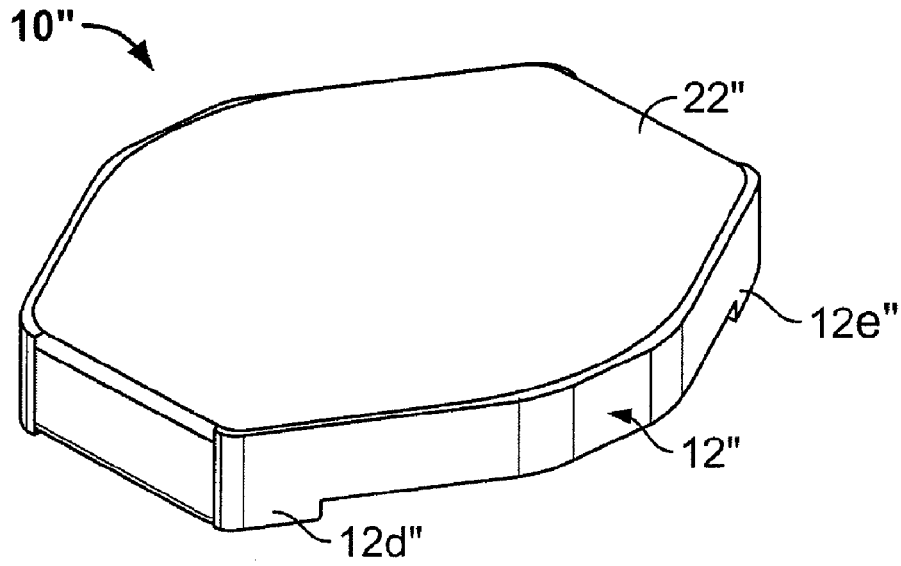
FIG. 3A is a perspective view of an alternate coil component embodying features of the present invention.
Figure 3B:
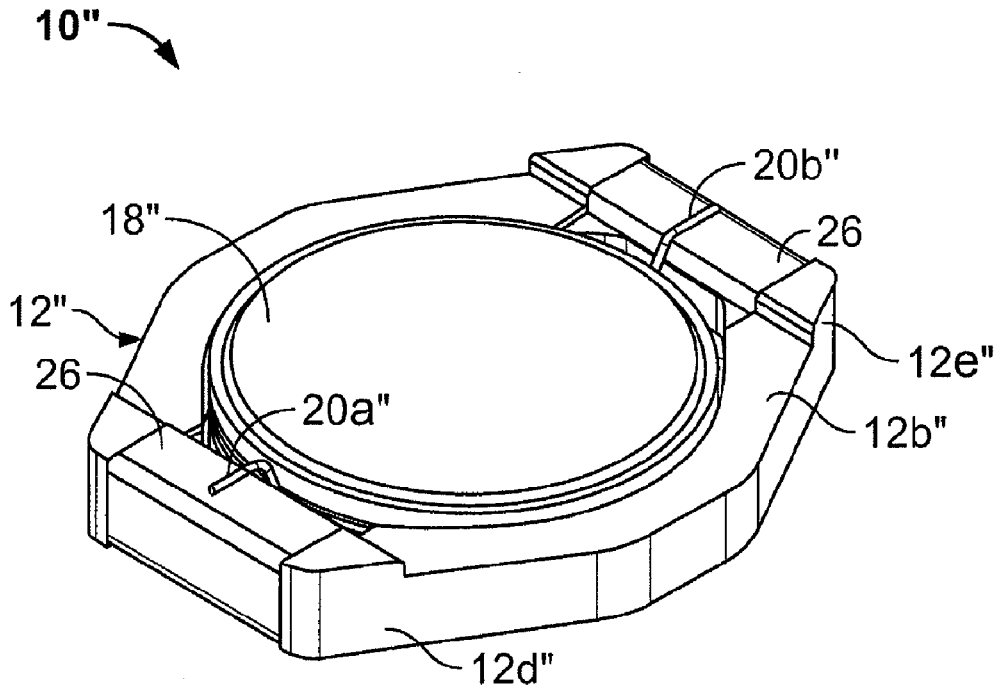
FIG. 3B is an alternate perspective view of the component of FIG. 3A.
Figure 3C:
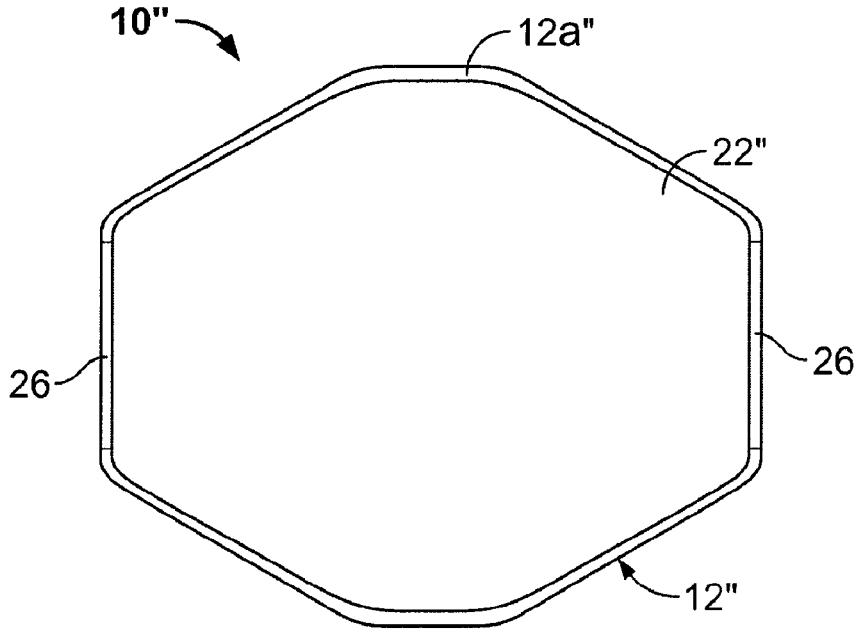
FIG. 3C is a plan view of the component of FIG. 3A.
Figure 3D:
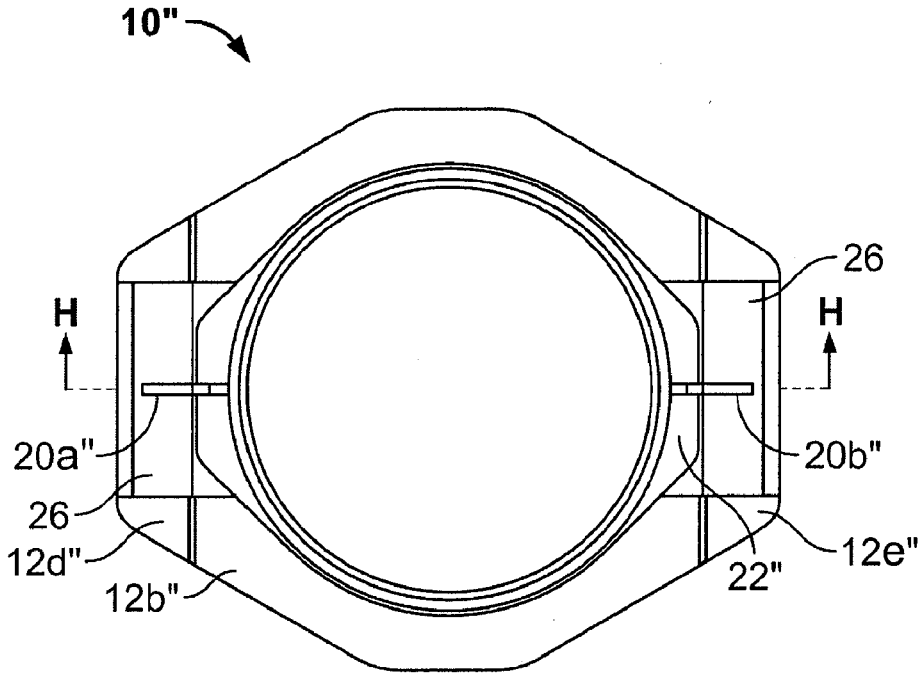
FIG. 3D is a bottom view of the component of FIG. 3A.
Figure 3E:
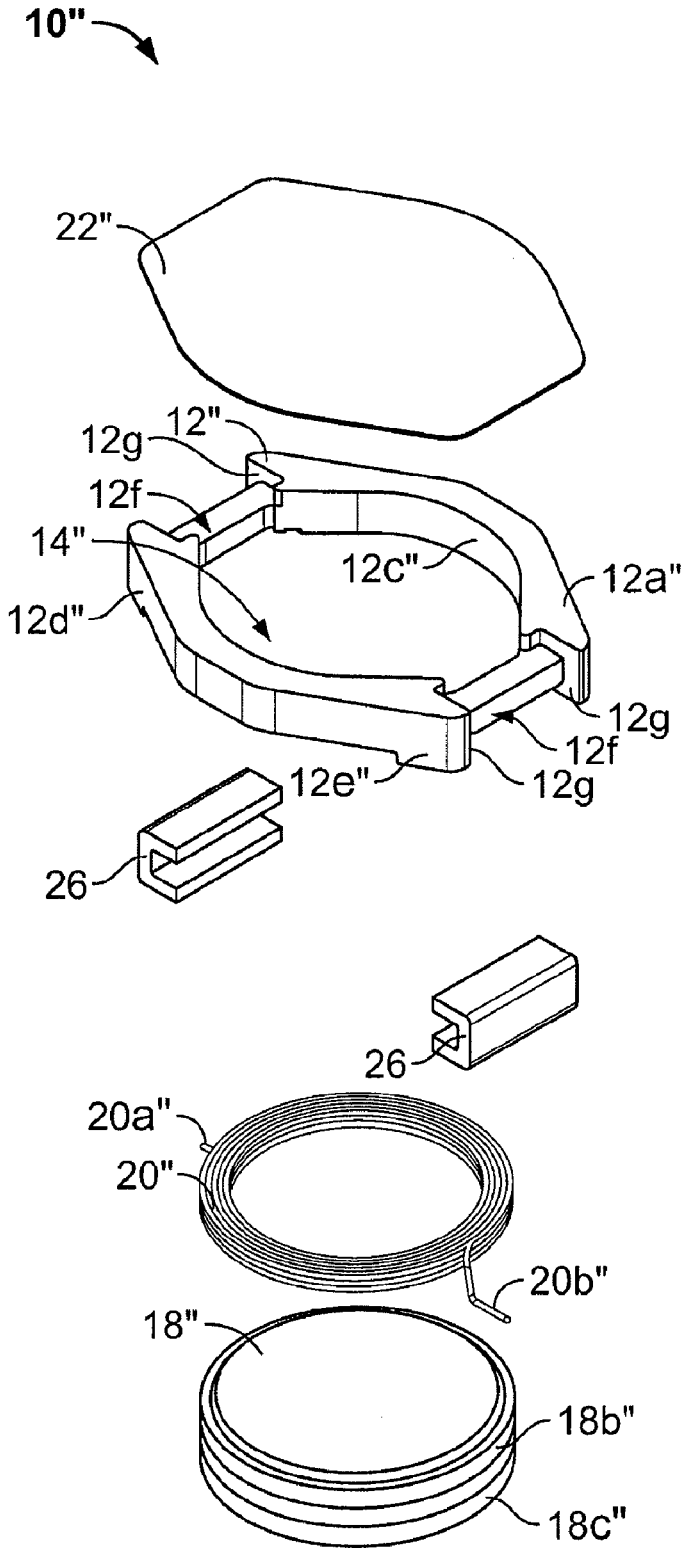
FIG. 3E is an exploded view of the component of FIG. 3A.
Figure 3F:
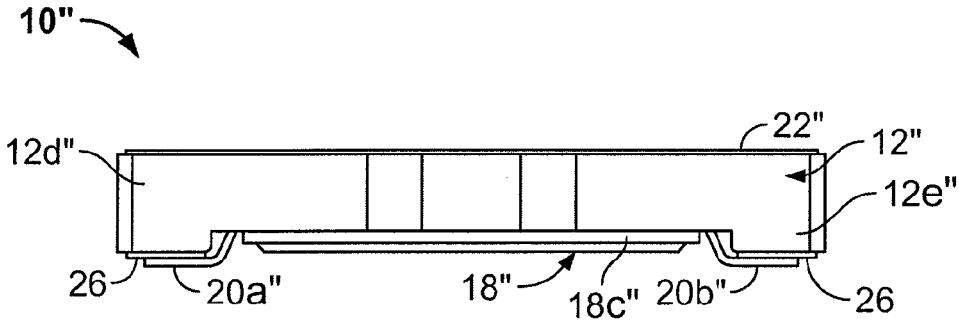
FIGS. 3F-G are side and end elevational views, respectively, of the component of FIG. 3A.
Figure 3G:
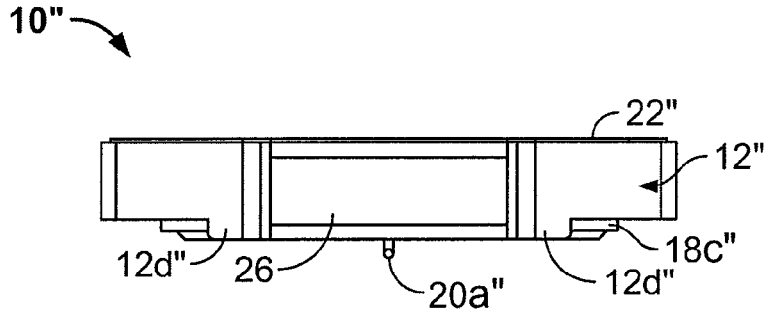
Figure 3H:
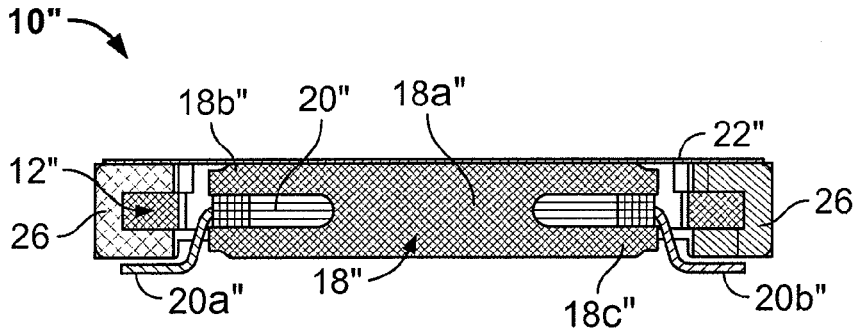
FIG. 3H a cross-sectional view of the component of FIG. 3A taken along line H-H in FIG. 3D.

As illustrated in FIGS. 1D and 1E, the inner wall 12*c* created by aperture 14 includes a pair of opposed arcuate surfaces connected by opposed flat surfaces. In a preferred embodiment, at least a portion of the opposed arcuate surfaces of inner wall 12*c* have a radius of curvature which corresponds to that of at least a portion of the core 18, such as a portion of upper flange 18*b*. The arcuate surfaces, however, straighten at their ends and join the opposed flat surfaces of inner wall 12*c* in such a way as to leave a gap between the core 18 and the opposed flat surfaces of inner wall 12*c*. As will be discussed further below, however, the component 10 may have a variety of differently shaped bases and apertures.

The inductive component 10 also includes a wire winding 20 which is wound about the center section 18*a* of the core 18. In a preferred embodiment, the wire 20 is an insulated wire such as a forty-two gauge copper wire having ends 20*a* and 20*b* connected to the bottom of the metalized pads 16. It should be understood, however, that any conductive material may be used for the wire and that the wire size may be selected from a variety of wire gauges. For example, a preferred component may use wire ranging from thirty-four gauge wire to forty-eight gauge wire, while alternate components use wires of different wire gauges.

The ends of the wire 20*a-b* are preferably flattened (not shown) and bonded to the metalized pads 16 in order minimize the amount of space between the lower surface of the metalized pads 16 and the upper surface of the corresponding PCB lands. This helps maintain the low profile of the component 10 and also helps ensure that the component will remain co-planar when positioned on the PCB so that the pads 16 and wire ends 20*a-b* will make sufficient contact with the solder on the PCB and make solid electrical and mechanical connections to the circuit on the PCB.

In alternate embodiments, the wire ends 20*a-b* may be connected to the outer side surface of L-shaped metalized pads, or inner or outer side surfaces of U-shaped metalized pads, in order to avoid disrupting the flat bottom surface of pads 16 and in order to avoid increasing the height of the component 10 and/or creating a gap between any portion of the pads 16 and the corresponding PCB lands. In yet other embodiments, notches or dimples may be present in the lower surfaces of the legs 12*d-e* and/or pads 16 in order to provide a designated location for the wire ends 20*a-b* to be bonded to the pads 16 without raising the height of the component 10 or creating a gap between the pads 16 and corresponding PCB lands.

The pieces of the inductive component 10, such as the base 12 and core 18, are held together via film 22 which has an adhesive layer and, as illustrated, may be positioned over the top of base 12*a* and core flange 18*b*. The film 22 serves as a structural member of the component. In a preferred embodiment, the film 22 comprises a flexible member having an adhesive layer on the bottom and a printable layer on the top. Thus, in addition to keeping the pieces of the component 10 together, the film 22 provides the component manufacturer with a surface for printing indicia such as product numbers, trademarks, and other desirable information. The film 22 also establishes a generally planar top surface with which the component 10 may be picked from a tape and reel packaging and placed on a PCB using industry standard vacuum pick-and-place machinery. In a preferred embodiment, film 22 may be a polyimide film, a polyetheretherketone (PEEK) film, a liquid crystal polymer (LCP) film or the like.

This component configuration allows for the pieces of component 10 to move with respect to one and other and to withstand the various stresses the component will be subjected to, such as thermal shock and cycling and mechanical shock and vibration. More particularly, the flexible film 22 provides play and space between the base 12 and core 18 so that such materials can expand and contract and shift vertically, horizontally and axially with respect to one another without damaging the component or causing a failure condition to occur. For example, film 22 allows the base 12 and core 18 to move independent of one another because there is no structure, such as a hardened body of glue, directly connecting the base 12 to the core 18. In other words, the film 22 allows for movement of one of the pieces (e.g., base or core) without necessitating that such movement translate into movement of the other piece (e.g., core or base). Thus, during a mechanical shock or vibration test, movement of the base 12 may not always translate into movement of the core 18, and if it does, may allow the base 12 and core 18 to move sufficiently independent of one another so that neither damage the other or cause the component 10 to crack or break.

Furthermore, in the embodiment illustrated, the core 18 is connected to the film 22 and base 12 via the entire upper surface of flange 18*b*, rather than by the edge of the flange 18*b* which, as mentioned earlier, is an inherently weak portion of the core and is capable of breaking more easily due to stresses such as axial flexure. Similarly, the base 12 is connected to the film 22 and core 18 via the entire upper surface 12*a* of base 12 rather than by opposed ends of the base 12. Thus, by increasing the surface area by which the core 18 and/or base 12 are connected in the component 10, the connection made with these pieces is made stronger and capable of withstanding greater stress.

Thus, the flexible film 22 is capable of withstanding the wide range of temperatures and other environmental conditions the component 10 will be subjected to during its lifetime. The fibrous nature of the film 22 also helps the component withstand additional stresses and environmental tests such as mechanical shock and vibration. Furthermore, the film 22 provides a uniform layer of adhesive and may be applied to the component 10 in an efficient manner. More particularly, film 22 eliminates many of the problems associated with existing adhesives, such as excessive glue application, leaking glue, glue overflow, and the like. The use of film 22 also allows the component to be manufactured more easily and efficiently via a simplified automated process.

Turning now to FIGS. 2A-I, there is illustrated an alternate embodiment of the component 10 embodying features in accordance with the present invention. In this embodiment, a differently shaped base is used in connection with the component 10. For convenience, features of alternate embodiments illustrated in FIGS. 2A-I that correspond to features already discussed with respect to the embodiments of FIGS. 1A-H are identified using the same reference numeral in combination with an apostrophe or prime notation (') merely to distinguish one embodiment form the other, but otherwise such features are similar.

The alternate embodiment of component 10, (hereinafter component 10'), includes a generally rectangular base 12' which is made of an insulating material, such as a non-conductive plastic or ceramic. Like body 12 above, body 12' has a polygonal shape, such as an octagon, and has a smooth planer top 12*a'* and bottom 12*b'*. The body 12' further defines an aperture 14' and has a pair of supports, such as legs 12*d'* and 12*e'*, extending downward from opposite ends of the body 12' which have metalized pads 16' located about the bottom thereof. A core 18' is disposed within the aperture 14' of base 12' and has a cylindrical center section 18*a'* about which a wire 20' is wound. The core 18' has upper and lower flanges 18*b'* and 18*c'*, respectively, extending from the ends of the center section 18*a'* and is connected to the base 12' and via an adhesive-type film 22'.

Unlike the component 10 above, however, the base 12' defines a generally circular aperture 14' and side wall 12*c*' within which the core 18' is disposed. More particularly, in the embodiment illustrated, the aperture 14' and side wall 12*c*' have a radius of curvature and diameter which corresponds to or compliments the radius of curvature and diameter of the upper flange 18*b*' of core 18'. Preferably, the flange 18*b*' fits loosely within the aperture 14' and inner wall 12*c*' so that space is provided between the edge of the flange 18*b*' and the inner wall 12*c*', and the core 18' is positioned such that the top of the upper flange 18*b*' is about even, or coplanar, with the top surface 12*a*' of body 12' and the lower surface of the lower flange 18*c*' is about even, or coplanar, with the bottom surface of either, or both, the legs 18*d*'-*e*' and metalized pads 16'.

In addition, the inner surface of the legs 12*d*' and 12*e*' have arcuate portions that have a radius of curvature which corresponds to at least a portion of the radius of curvature of the core 18', and more particularly to the upper flange 18*b*'. The arcuate portions allow for larger legs 12*d*' and 12*e*' and metalized pads 16' to be used in conjunction with component 10', thereby increasing the surface area with which the pads 16' and legs 12*d*'-*e*' are connected and the surface area with which the pads 16' and corresponding lands on the PCB are connected. As mentioned above, such an increase in surface area helps create a stronger mechanical connection or bond between these items and a better electrical connection between the component 10' and the circuit of the PCB.

In FIGS. 3A-H, there is illustrated yet another embodiment of the component 10 embodying features in accordance with the present invention. In this embodiment, alternate metalized pads are used in connection with the component 10. For convenience, features of alternate embodiments illustrated in FIGS. 3A-H that correspond to features already discussed with respect to the embodiments of FIGS. 1A-H and 2A-I are identified using the same reference numeral in combination with a double prime notation (") merely to distinguish one embodiment form the other, but otherwise such features are similar.

In FIGS. 3A-H, the alternate embodiment of component 10, (hereinafter component 10"), includes a similar structure to that of component 10 in FIGS. 1A-I. For example, component 10" has a polygonal shaped body 12" made of an insulating material. The body 12" further defines an aperture 14" and has a pair of supports, such as legs 12*d*" and 12*e*", extending downward from opposite ends of the body 12". A core 18" is disposed within the aperture 14" of base 12" and has a cylindrical center section 18*a*" about which wire 20" is wound. Like the cores discussed above, the core 18" has upper and lower flanges 18*b*" and 18*c*", respectively, extending from the ends of the center section 18*a*" and is connected to the base 12" and via film 22".

One way in which the component 10" differs from components 10 and 10' discussed above, however, is that the metalized pads of the component 10" (hereinafter 26) are interconnected with the body 12". For example, in a preferred embodiment, the metalized pads 26 are formed like dips for engaging at least a portion of the body 12" having a complimentary shape. The dip-type pads 26 may be designed to interlock with the base 12" or, alternatively, may simply engage the base 12" via a tongue and groove type configuration, as shown.

In FIGS. 3A-H, the C-shaped clips 26 are connected to complimentary wells or recesses 12*f* on base 12" in a tongue and groove manner. The recessed portions 12*f* have alignment structures, such as end stops or walls 12*g*, which prevent the clips 26 from being misaligned on the base 12". The base 12", core 18", wire 20" and pads 26 are then connected to one another via film 22" in a manner similar to that discussed above with respect to components 10 and 10'.

In alternate embodiments, the pads 26 may be mechanically attached to the base to improve the structural connection between the pads 26 and base 12". For example, the pads 26 may be mechanically crimped onto the base 12" or insert molded onto the base so that at least a portion of the pad 26 is anchored to the base to prevent unwanted movement between these components. Once the pads 26 are connected to the base 12" (in whichever fashion), the ends 20*a*"-*b*" of wire 20" are connected to a surface of their respective pads 26 so that the component may be operated in the intended fashion.

As illustrated in FIGS. 3A-H, the ends 20*a*"-*b*" of wire 20" are preferably connected to the lowermost surface of the C-shaped pads 26. It should be understood however, that in alternate embodiments the ends 20*a*"-*b*" may be connected to the pads 26 in a variety of ways, such as for example, by connecting the ends 20*a*"-*b*" to the outermost side surface or the uppermost surface of the pads 26. In the latter configuration, however, one must be careful not to significantly upset the generally planar top surface of the component 10" so that it can be picked up and placed via industry standard equipment. Once assembled, the component 10" may be electrically and mechanically connected to a PCB.

Figure 4A:
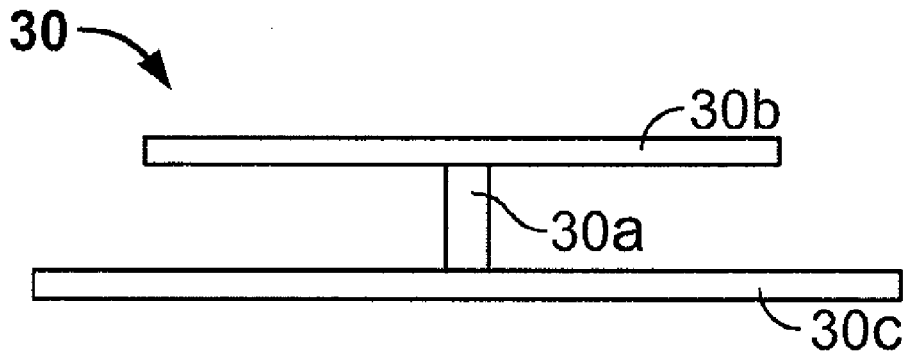
FIGS. 4A-B are side elevational and perspective views, respectively, of an alternate core which may be used in a component embodying features of the present invention.
Figure 4B:
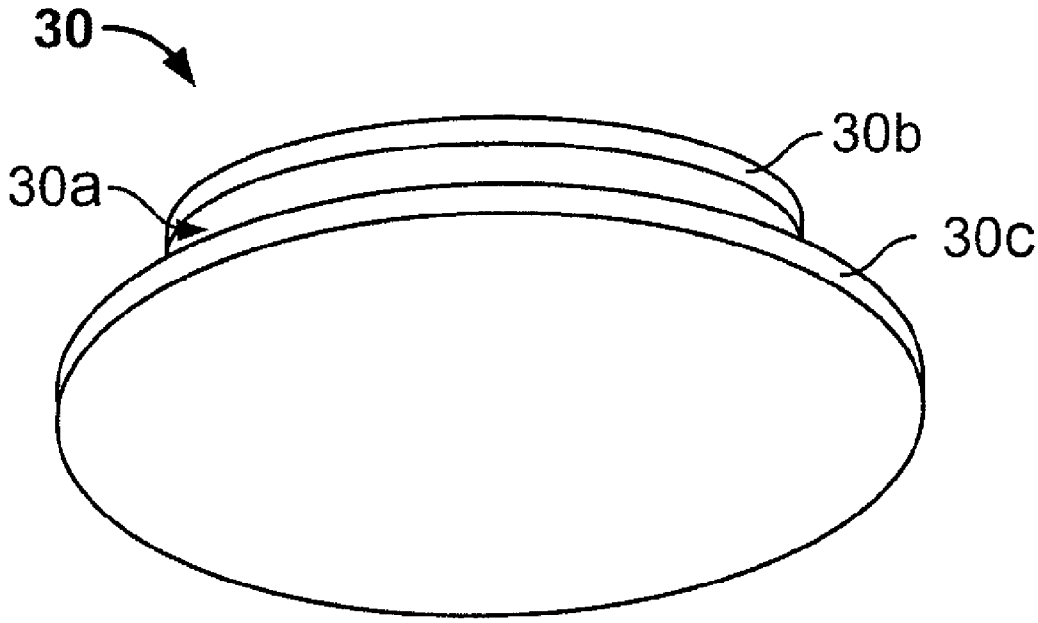

Although the cores illustrated in FIGS. 1A-H and 2A-I are symmetrical, it should be understood that a variety of different cores may be used, including asymmetrical cores such as the core in FIGS. 4A B. More particularly, the core in FIGS. 4A-B (hereinafter core 30) includes a cylindrical center portion 30*a* with upper and lower flanged portions 30*b* and 30*c*, respectively, extending from the ends thereof. In this asymmetrical configuration, the upper flange 30*b* is of a smaller diameter than the lower flange 30*c*. It should be understood, however, that the core 30 could be designed so that the upper flange 30*b* has a larger diameter than the lower flange 30*c*, if desired.

In a preferred embodiment, the components 10, 10' and 10" are low profile surface mount components with heights ranging between 2 mm and 0.5 mm or smaller. For example, the components 10 and 10" illustrated in FIGS. 1A-H and 3A-H may have a length of approximately 6.0 mm, a width of approximately 5.0 mm, and a height of approximately 1.0 mm. The component 10' illustrated in FIGS. 2A-I may have a length of approximately 6.3 mm, a width of approximately 5.4 mm, and a height of approximately 1 mm. It should be understood, however, that these dimensions are only exemplary and may vary individually or as a whole depending on the application for which the component is being designed. For example, the component 10' illustrated in FIGS. 2A-I may also be provided in a package having a length of approximately 4.6 mm, a width of approximately 4.3 mm, and a height of approximately 1.2 mm.

Thus, in accordance with the present invention, a low profile inductive component is provided that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A method of assembling a discrete electronic component, comprising:

providing an electronic component having a body defining an aperture, a core having first and second ends connected together by an elongated member of reduced diameter as compared to the first or second core ends, first and second surface mount terminals connected to one or both of the body and the core, and a flexible film member with a first and second side, wherein the first side has an adhesive and the second side has a printable substrate;

winding a conductor having first and second ends around at least a portion of the core;

inserting at least a portion of the core into the aperture so that an upper surface of the core is substantially coplanar with an upper surface of the body;

electrically connecting the first and second ends of the conductor to the first and second surface mount terminal, respectively; and applying the flexible film member to at least a portion of the upper surfaces of the body and core to indirectly secure the body and core to one another thereby forming an assembled electronic component capable of being surface-mounted on a printed circuit board so that the core remains indirectly secured to the body and moveable with respect thereto.

2. A method according to claim 1 wherein applying the flexible film to at least a portion of the upper surfaces of the body and core comprises adhering the film to at least a portion of the upper surfaces of the body and core by applying the adhesive side of the film to the at least a portion of the upper surfaces of the body and core to secure the body and core to one another.

3. A method according to claim 1 wherein the assembled electronic component has at least one dimension associated with width, length or height and applying the film comprises applying the film such that the film does not extend substantially beyond the at least one dimension.

4. A method of manufacturing a discrete electronic component, comprising:

providing an electronic component having a body defining an aperture, a core with first and second ends connected together by an elongated member of reduced diameter as compared to at least one of the first or second core ends, first and second surface mount terminals connected to one or both of the body and the core, and a flexible film member;

inserting at least a portion of the core into the aperture such that the core and aperture are coaxial;

winding a wire having first and second wire ends about at least a portion of the elongated member of the core between the first and second core ends;

connecting the first and second wire ends to the first and second surface mount terminal, respectively; and applying the flexible film member directly to at least a portion of the core and body such that the film member is substantially radially-transverse to the aperture to indirectly secure the core and the body to one another thereby forming an assembled electronic component capable of being mounted on a printed circuit board.

5. A method according to claim 4 wherein the film has an adhesive layer and the method comprises adhering the film to the core and the body without requiring reflow.

6. A method according to claim 5 wherein adhering the film to the core and the body further comprises adhering the film to the core and the body such that at least a portion of the core and at least a portion of the body can move independently of one another.

7. A method according to claim 4 wherein the core has a longitudinal axis running through the center of the first and second core ends and the elongated member extending therebetween, the method further comprising:

applying the film to a surface of the core that is substantially normal to the longitudinal axis of the core.

8. A method according to claim 4 wherein applying the flexible film comprises applying the film so that the film forms a substantially planar surface with which the component may be picked up and placed on a circuit board using conventional pick-and-place equipment and surface-mounted and electrically connected into a circuit an said printed circuit board.

9. A method according to claim 4 wherein the assembled electronic component has at least one dimension associated with width, length or height and applying the film comprises applying the film such that the film does not extend substantially beyond the at least one dimension.

10. A method of manufacturing a discrete electronic component, comprising:

providing a body having an upper surface defining an aperture and a core having an upper surface and first and second ends connected together by an elongated member of reduced diameter as compared to the first or second core ends, a generally planar flexible film member and first and second metalized terminals wherein the first and second metalized terminals have upper surfaces;

inserting at least a portion of the core into the aperture;

winding a conductor having first and second ends around the elongated member of the core between the first and second core ends;

electrically connecting the first and second ends of the conductor to the first and second metalized terminal, respectively; and applying the generally planar flexible film member to at least a portion of the upper surfaces of the body, core and first and second metalized terminals to secure the body, core, and terminals to one another to form a finished product capable of being surface-mounted into an electronic circuit on a printed circuit board.

11. A method according to claim 10 wherein the finished product has at least one dimension associated with width, length or height and applying the film comprises applying the film such that it does not extend substantially beyond the at least one dimension.

12. A method of manufacturing a discrete electronic component, comprising:

providing a body having an upper surface, a core having an upper surface, a generally planar flexible film member, and first and second metalized terminals wherein the first and second metalized terminals have upper surfaces;

winding a conductor having first and second ends around the core;

electrically connecting the first and second ends of the conductor to the first and second metalized terminals respectively; and applying the generally planar flexible film member to at least a portion of the upper surfaces of the body, core and first and second metalized terminals to secure the body, core and metalized terminals to one another to form a finished product capable of being surface-mounted to a printed circuit board and electrically connected into a circuit on said printed circuit board.

13. A method according to claim 12 wherein the finished product has at least one dimension associated with width, length or height and applying the planar film comprises applying the film such that it does not extend substantially beyond the at least one dimension.

14. A method of assembling a discrete surface mount electronic component, comprising:

providing an electronic component having a body defining an aperture, a core having first and second ends connected together by an elongated member of reduced diameter, first and second surface mount terminals connected to one or both of the body and the core, and a flexible film member with a first and second side, wherein the first side has an adhesive and the second side has a printable substrate;

winding a conductor having first and second ends around the core;

inserting at least a portion of the core into the aperture so that an upper surface of the core is substantially coplanar with an upper surface of the body;

electrically connecting the first and second ends of the conductor to the first and second metalized terminals, respectively; and applying the flexible film member to at least a portion of the upper surfaces of the body and core to indirectly secure the body and core to one another thereby forming an assembled electronic component capable of being surface-mounted on a printed circuit board so that the core remains indirectly secured to the body and moveable with respect thereto.

15. The method according to claim 14 further comprising printing indicia on the second side of the flexible film member thereby forming an assembled electronic component capable of being surface-mounted on a printed circuit board and having a readable label atop the component.

16. A method of assembling a discrete electronic component, comprising:

providing an electronic component having a body defining an aperture, a core having first and second ends connected together by an elongated member of reduced diameter as compared to at least one of the first or second core ends, a wire winding having first and second wire ends, first and second surface mount terminals connected to one or both of the body and core, and a flexible film member having first and second sides;

winding the wire about at least a portion of the core located between the first and second ends of the core;

inserting at least a majority of the core into the aperture defined by the body so that an upper surface of the core is substantially coplanar with an upper surface of the body;

connecting the first and second wire ends to the first and second surface mount teminal, respectively; and applying the flexible film member to at least a portion of the upper surfaces of the body and core to secure the body and core to one another thereby forming an assembled electronic component capable of being surface-mounted on a printed circuit board and electrically connected to a circuit on said printed circuit board.

* * * * *

UNITED STATES PATENT AND TRADEMARK OFFICE

CERTIFICATE OF CORRECTION

PATENT NO. : 8,156,634 B2
APPLICATION NO. : 11/137730
DATED : April 17, 2012
INVENTOR(S) : David A. Gallup and Lawrence B. LeStarge It is certified that error appears in the above-identified patent and that said Letters Patent is hereby corrected as shown below:

IN THE CLAIMS:

In Column 10, Line 11, Claim 8, delete “an” and insert -- on --, therefor.

In Column 12, Line 21, Claim 16, delete “teminal,” and insert -- terminal, --, therefor.

Signed and Sealed this
Seventh Day of August, 2012

David J. Kappos

David J. Kappos
*Director of the United States Patent and Trademark Office*